United States Patent [19]

Serra

[11] 4,321,717

[45] Mar. 30, 1982

[54] SOFA BED

[75] Inventor: Felipe S. Serra, Santurce, P.R.

[73] Assignee: Luis F. Segarra Boerman, Santurce, P.R.

[21] Appl. No.: 167,789

[22] Filed: Jul. 11, 1980

[51] Int. Cl.[3] ..... A47C 17/16; A47C 31/00

[52] U.S. Cl. ..... 5/26 D; 5/43; 5/508; 362/131

[58] Field of Search ..... 5/26 D, 26 R, 26 B, 5/24, 25, 43, 45, 12 R, 200 R, 53 R, 508; D6/61, 62, 63; 362/131; 297/118

[56] References Cited

U.S. PATENT DOCUMENTS

| | | | |
|---|---|---|---|
| D. 45,708 | 5/1914 | Giordano | 5/508 |
| 120,270 | 10/1871 | Hall | 5/43 |
| 819,068 | 5/1906 | Ives | 5/508 |
| 1,001,390 | 8/1911 | Gross | 5/24 |
| 1,500,057 | 7/1924 | Corns | 5/508 |
| 4,106,137 | 8/1978 | Leclerc | 5/26 R |
| 4,114,215 | 9/1978 | Santo | 5/400 |

FOREIGN PATENT DOCUMENTS

| | | | |
|---|---|---|---|
| 55173 | 5/1935 | Norway | 5/24 |

*Primary Examiner*—Alexander Grosz

*Attorney, Agent, or Firm*—Marvin Feldman; Stephen E. Feldman

[57] ABSTRACT

A sofa bed is described herein which is converted from a seating mode to a bed through manual operation. The movable part of the bed forms the back of the sofa when disposed in a vertical mode and serves as the bed when disposed in a horizontal mode. The converting mechanism is simple and jam proof, resulting in a highly reliable sofa bed operation. Further, the sofa bed is capable of being manufactured almost entirely of wood, thereby limiting the metal requirements.

13 Claims, 6 Drawing Figures

SOFA BED

FIELD OF THE INVENTION

This invention relates to a sofa bed.

BACKGROUND OF THE INVENTION

It is desirable in confined space areas, such as modern studio apartments, to have a sofa bed which takes up a minimum of floor space both in the seating and bed modes. It is also desirable by occupants of such apartments to outlay a relatively small expenditure of money in order to get the functions of individual pieces of furniture. It is also desirable that the sofa bed construction minimize the complexity of the mechanical elements needed to convert from a sofa to a bed.

Heretofore, most such sofa bed combinations have employed extremely complicated conversion mechanisms, which were susceptible to jamming, and further susceptible to possibly injuring the person who is making the conversion since, in many cases, the mechanisms such as linkages are exposed.

The prior art sought to alleviate some of the aforesaid problems but to date have not been entirely successful.

U.S. Pat. No. 2,534,177, to A. Lorenz, et al, discloses a combined sofa seat and bed which employs a three part back and seat cushion which through complex linkages ultimately converts into a flat bed.

U.S. Pat. No. 2,597,995, to M. C. Jenkins, shows a combination sofa bed which, when the couch is converted to a bed, causes the bed portion to extend beyond the confines of the couch portion and thus takes up much more space than the couch portion itself.

U.S. Pat. No. 2,634,492, to A. A. Hopeman, Jr., et al, discloses a combined folding bed and seat which is based on a complex mechanism which may be prone to jamming.

U.S. Pat. No. 2,849,730, to J. Polatsek, discloses a convertible davenport which is power operated. A two-part back is moved in a track by a power drive from a sofa back to a bed, with the seat concommitantly moved. The bed is cantilevered over the sofa frame.

Another U.S. Pat. No. 3,000,598, to S. Zimmerspitz, describes a convertible seat and couch unit which when the bed portion is brought into position causes the bed to extend outside of the confines of the couch portion, thereby taking up more space than the couch portion alone.

U.S. Pat. No. 3,327,327, to E. Nadich, describes a sofa bed in which a bed is underneath the seat and the seat and back portion are move out of the way to permit the bed portion to come into position when the bed is to be used. This mechanism requires several complex levers and arms.

SUMMARY OF THE INVENTION

The sofa bed of the present invention now provides a design in which the back of the sofa is directly pivoted into a horizontal position to form a bed.

Accordingly, it is an object of the present invention to provide a sofa bed which eliminates the need for complex linkages.

Another object of the invention is to provide a conversion mechanism which is extremely simple to operate and eliminates jamming.

Yet another object of this invention is to provide a sofa bed construction which requires extremely simple manufacturing operations and requires a minimum of metal parts.

Yet another object of this invention is to provide a sofa bed which has storage space for bedding materials.

Still another object of this invention is to provide electrical accessories items within the sofa bed which may be used in either the sofa or bed mode.

A still further object of this invention is to provide an inexpensive furniture module that can be used in presently available compact apartments, whereby use and operation of the furniture module requires a minimum of floor space.

BRIEF DESCRIPTION OF THE DRAWINGS

The invention will be made more clearly under stood from the following description of specific embodiments of the invention, together with the accompanying drawings, in which.

BRIEF DESCRIPTION OF THE PREFERRED EMBODIMENT

Figure 1:
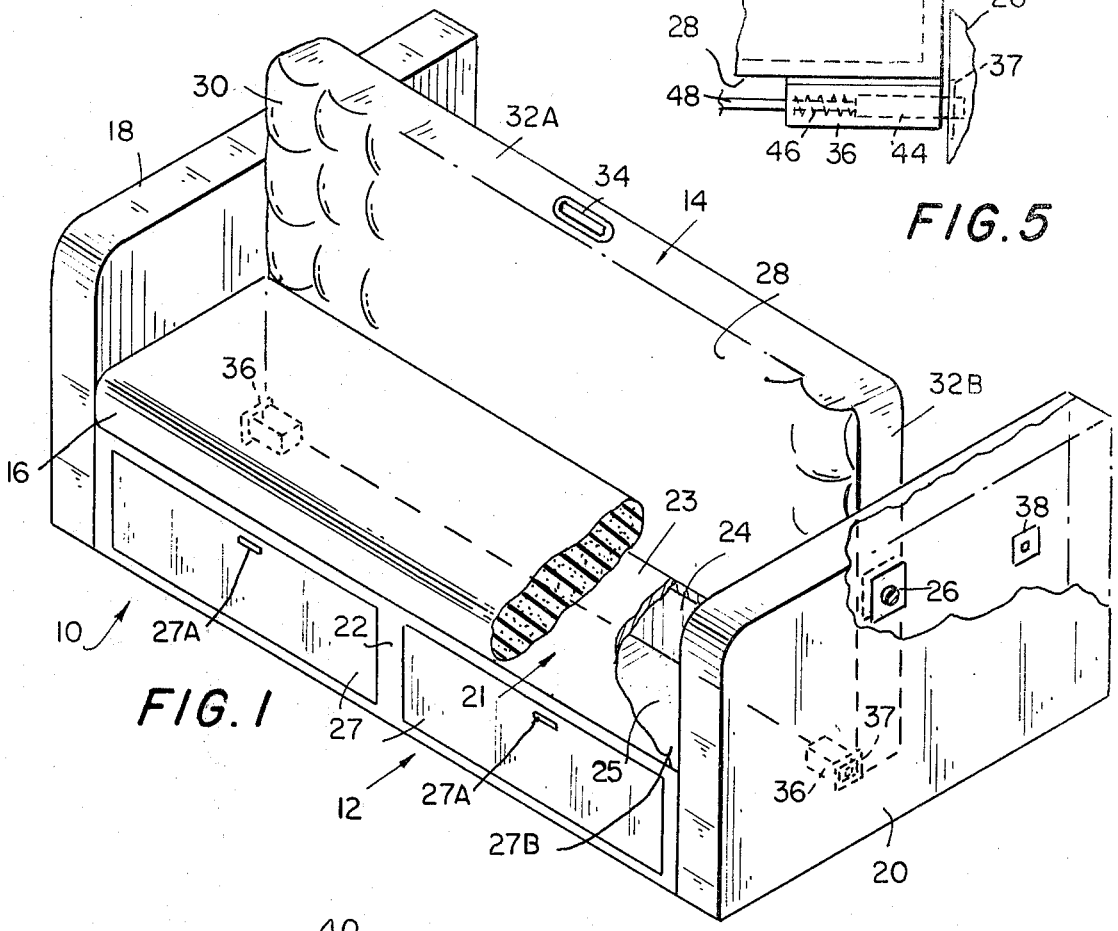
FIG. 1 is a front perspective view of the sofa bed unit.

Referring now to the drawings and more particularly to FIG. 1, there is depicted the sofa bed unit of the present invention, generally designated by numeral 10. The sofa bed unit 10 comprises of a U-shaped main frame 12 and a back and bed unit 14 disposed within the main frame. Disposed on the center portion of main frame 12 is a removable foam rubber seat cushion 16. Main frame 12 consists of several portions, namely first and second side arms 18 and 20 which are attached respectively to a front surface or member 22. Front surface 22 derives additional rigidity from a box structure 21 formed by front surface 22, a top surface 23, a rear surface 24 and a bottom surface 25. Front surface 22 provides a pair of access or storage doors 27 with handles 27A to form a storage area 27B. Attached to front surface 22 at the end opposite first side arm 18 is the second side arm 20 which completes the U-frame 12.

The back and bed unit 14 is pivotally mounted within U-frame 12. On the inner surface of both arms 18 and 20 are located a pair of pivot assemblies 26 which rotatably support back and bed unit 14. Back and bed unit 14 comprises a structure made up of a cover member or board 28 having a quilted surface 30 attached thereto. Oppositely disposed to the quilted surface 30 is an opening formed by a series of sides or side boards 32A, 32B, 32C and 32D. Side board 32A has an operating handle 34 centrally disposed therein for purposes hereinafter appearing. Affixed to the bottom-most portion of cover 28 are a pair of latches 36 which engage a first catch or lock plate pair 37 located on the bottom portions of the respective inner surfaces of both side arms 20 and 18, when the unit 14 is in the sofa mode. A second catch or lock plate pair 38 is located on the rear portion of the inner surface of both side arms 20 and 18, and are disposed rearwardly and upwardly from the first pair of plates.

Figure 2:
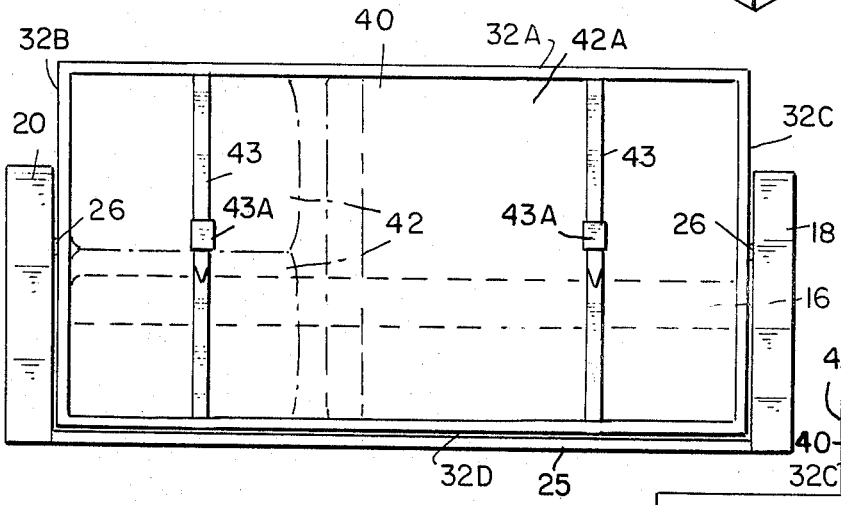
FIG. 2 is an elevational view of the rear of the unit as shown in FIG. 1.
Figure 3:
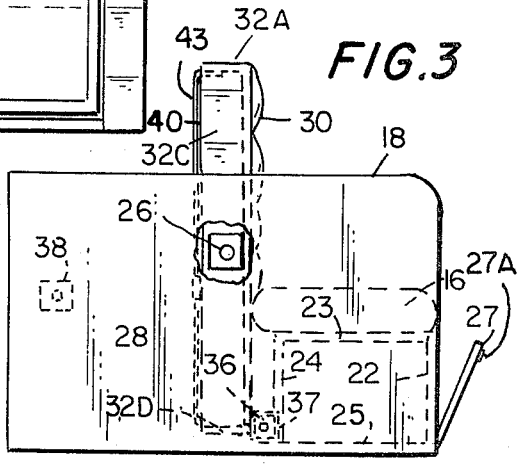
FIG. 3 is a side view of the unit.

Referring now specifically to FIGS. 2 and 3, there is shown the back of sofa bed 10, and more specifically the relationship of the side arms 18 and 20 to the back and bed unit 14. Pivot air assemblies 26 are mounted to and rotatably engage the sides 32B and 32C of back and bed unit 14. A bedding assembly 40 is shown contained within the opening made by sides 32A–32D of back and bed unit 14, which bedding assembly comprises a pair of pillows 42 and bedding 42A (i.e., mattress, sheets and covers) retained within th opening by strap pair 43. The ends of strap pair 43 are fixedly mounted to the inner surfaces of sides 32A and 32D. Further, the straps are adjustably secured by buckles 43A, of well known construction. It is to be understood that the pillows or other parts of the bedding, except for the mattress, may be stored in area 27B. However, the invention contemplates a fully made bed being held within the back of unit 14, when the unit is in the sofa mode. Of course, in such mode, the bedding is hidden from view at the front of the sofa.

Figure 4:
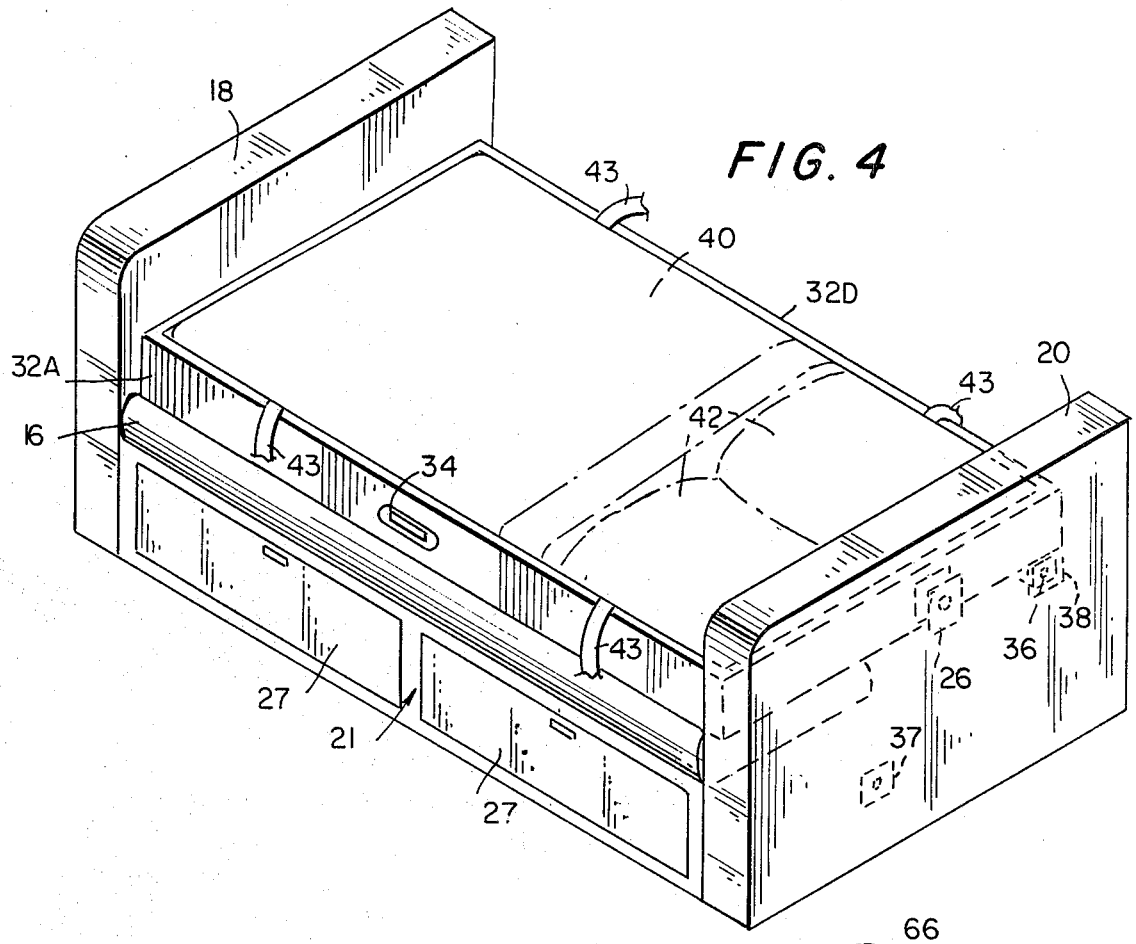
FIG. 4 is a front perspective view of the sofa bed unit converted to a bed.

Referring to FIGS. 3 and 4, the back and bed unit 14 is rotatably attached by one of the pair of pivot assemblies 26 to the side arm 18 as shown in the cut away portion. Seat cushion 16 is disposed within the confines of the arms and U-frame, and the entire unit 14 is also within the same confines (FIG. 4). Shown also is one of the pair of latches 36, and in the same area as latches 36 is first catch plate 37. Latches 36 and first catch plates 37 are engaged when back and bed unit 14 is in the substantially vertical position as shown in FIG. 3. When it is in the horizontal position, latches 36 engaged second catch plate pair 38. Also shown in FIG. 3 are the access drawers 27 in the open position to receive bedding materials. In FIG. 4, straps 43 have been removed to permit unobstructed access to the pillows 42 and bedding 40 for use or removal to storage.

It is within the contemplation of this invention that the bedding retained by the straps within the sides 32A–32D be a complete set and include a conventional unitary mattress, a form fitted sheet, a cover, and if desired, pillows as well. The pillows or any other part of the bedding may be stored in the access or storage areas.

Figure 5:
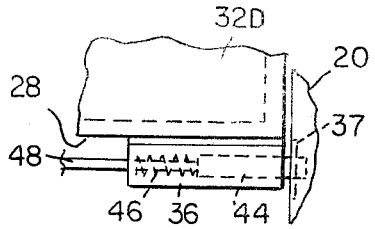
FIG. 5 is a fragmentary view of a locking mechanism used to lock the sofa bed unit.

Reference to FIG. 5 shows the details of one of the pair of latches 36. Latches 36 are affixed to cover member 28 as shown. Each latch 36 comprises a bolt 44, a spring 46, and a cable 48 coaxially mounted and housed within the latch body. With the spring 46 expanded, bolt 44 protrudes from latch 36 and enters an opening in catch plate 37. Catch plate 37 is affixed to a bottom portion of the inner surface of the side arm 20. When it is desired to use the bed aspect of the sofa bed 10, the person wishing to do so grasps operating handle 34, and by pulling the handle 34, in turn pulls a pair of interconnected cables, or like elements 48, attached at respective ends to each latch 36. The cables 48 may be slidably mounted on board 28, if desired. The above described movement of cables 48 results in each bolt 44 being withdrawn into each of the respective latches, 36 and spring 46 is thereby held under compression. Withdrawal of bolt 44 removes the locking action present when bolt 44 engaged catch plate 37.

With the above described conditions present, the user is then free to manually rotate back and bed unit 14 about the pair of pivot assemblies 26 from the vertical position of FIG. 3, into the horizontal position shown in FIG. 4 while pulling handle 34. Then releasing operating handle 34 allows each bolt 44, under the urging of each spring 46 to engage second catch plate pair 38. When second catch plate pair 38 is fully engaged, back and bed unit 14 is now locked into the bed position. The bed when locked into place is supported by the locking plate elements 38. The sofa bed is designed so that back and bed unit 14 may be balanced about the pair of pivot assemblies 26, in order that a minimum of force need be exerted by the person who converts from sofa to bed and from bed to sofa. When back and bed unit 14 is locked into the sofa position, persons sitting on seat cushion 16 can lean backward or inadvertently pull forward on unit 14, without having unit 14 move from its locked position. After back and bed unit 14 is locked into the bed position, strap pair 43, is now disconnected and removed from the bedding assembly 40 area, as best seen in FIG. 4, wherein strap pair 43 is shown hanging over the edge of back and bed unit 14.

Figure 6:
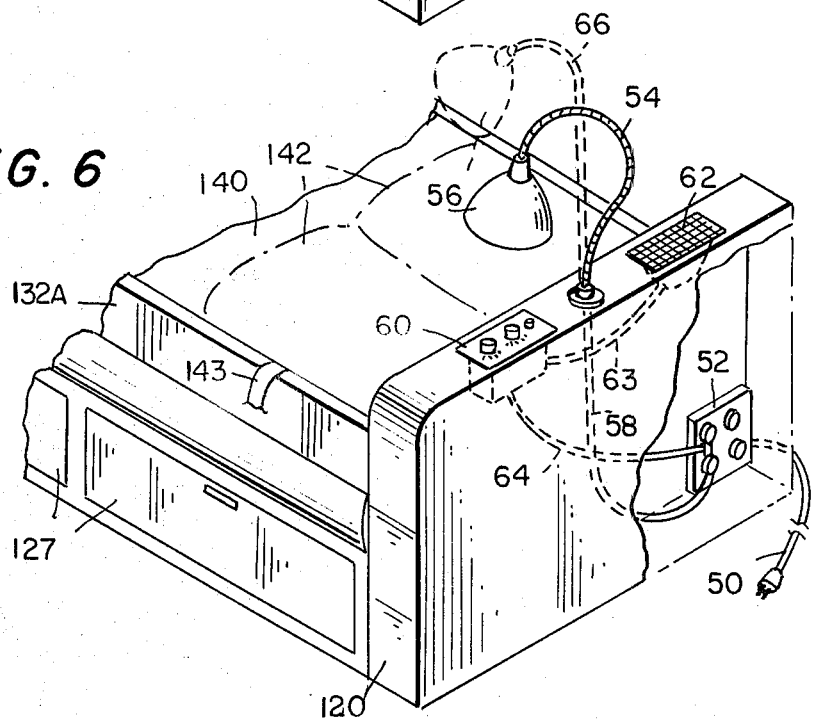
FIG. 6 is a partial front perspective view of another embodiment of the present invention showing the sofa bed unit with accessory equipment and a power outlet.

Referring to the embodiment of FIG. 6, there is shown a unit having similar construction elements as FIG. 5, wherein elements 120, 127, 132A, 143, 140 and 142 correspond to similar elements 20, 27, 32A, 43, 40 and 42 of the embodiment of FIG. 5. This latter embodiment also comprises a power cord 50 which provides power to a power center 52 located on the lower rear inside portion of the side arm 120. An adjustable lamp such as a goose neck lamp 54 is attached to the top most surface of the side arm 120. Lamp 54 comprises a shade or reflector 56 attached thereto. Lamp 54 derives electric power from power center 52, via a wiring 58. Also seen on the top most surface of side arm 20 is a radio 60 connected to a speaker 62 similarly mounted. A speaker connection 63 makes the electrical connection between radio 60 and speaker 62. Wiring 64 provides power to radio 60 from power center 52. An alternate position 66 illustrates the position of goose neck lamp 54 when sofa bed 10 is used as a sofa. Thus, lamp 54 serves as a reading lamp in both the seating and bed mode. The power center is mounted within the arm for aesthetic and safety purposes, as well as to permit flush mounting of the sofa bed for optimum space utilization. By this manner of construction, the sofa bed serves as a complete furniture module, whereby not only a sofa and a bed are designed with the unit, but electrical accessories, such as a radio and lamp are integral to and housed therewithin.

One important aspect of the present invention is that the entire sofa bed may be installed in a limited access space and still be fully operational. Specifically, the back and bed unit when being moved into and locked in the bed mode is disposed within the confines of the side arm and the seat. Thus, there are no extensions or cantilevered portions. Furthermore, the seat itself while removable for cleaning may nevertheless remain stationary and need not be moved or protrude from the sofa bed. It is to be borne in mind that this construction permits the back of the sofa bed to be flush mounted to a wall. Furthermore, insofar as there is no protrusion of extension of the bed forwardly of the sofa bed frame, there need be only a minimum of floor space in front of the sofa bed. In addition, the arm accessory construction provides a complete furniture module, which may be side wall flush mounted as well, further optimizing space utilization.

Another important aspect of the present invention is that the sofa bed construction may be of substantially all wood or wood/plastic composite, such as pressed board, with only the latch elements, latch plates and pivot assemblies comprising metal features. If desired, a metal frame can interconnect the latch plates and provide further floor support for the bed.

The embodiments of the invention particularly disclosed and described hereinabove are presented merely as examples of the invention. Other embodiments, forms and modifications of the invention coming within the scope and spirit of the appended claims will, of course, readily suggest themselves to those skilled in the art.

What is claimed:

1. A sofa bed comprising:

a pair of parallel arms;

a top and a seat cushion disposed on the top and between said arms said cushion being removable from said top; and a member comprising a backrest surface and a bed surface, said member being disposed between said arms, and further comprising pivot means comprising a single pivot action and being disposed above said seat cushion and operatively connected to said member for moving said member, said seat cushion being unmoved from the top in the movement of said member, said pivot means being disposed within the plane of said member, said pivot axis being midway between the sides of said member so that said member is balanced with respect to said pivot means and said member is upright in the seating mode, whereby said member is pivotally movable from a seating mode to a bed mode with the member being disposed above said seat cushion.

2. The sofa bed of claim 1, wherein said pivot means is disposed between said member and said arms, and said backrest surface and a bed surface are oppositely disposed on said member.

3. The sofa bed of claim 2, wherein said member is disposed within the confines of said arms and said seat cushion when in the bed mode.

4. The sofa bed of claim 2, said back rest surface and said bed surface comprises opposite sides of a one piece flat board.

5. The sofa bed of claim 1, wherein said back rest member is independently movable of said seat cushion.

6. The sofa bed of claim 1, wherein said member further comprises latch means for locking said member in said seating mode and said bed mode.

7. The sofa bed of claim 1, wherein said bed surface comprises means for retaining a conventional unitary mattress.

8. The sofa bed of claim 1, further comprising storage means disposed below said seat cushion in both said modes.

9. The sofa bed of claim 1, said bed surface comprising fixed frame members forming a rectangular recess sized for receiving a conventional unitary mattress and means to retain said mattress in said recess in the seating mode.

10. The sofa bed of claim 1, further comprising means to lock said member in said bed mode.

11. The sofa bed of claim 10, said locking means further comprising means to support said member in said bed mode.

12. The sofa bed of claim 1, said arms, seat and member comprising substantially non-metal construction.

13. A sofa bed comprising:

a pair of arms, at least one of said arms comprising lamp mounting means, and a lamp disposed on said mounting means, said lamp comprising means to move said lamp from a first position to a second position, and electrical conduit means connecting said lamp to a power supply; wherein each of said arms comprises wood members forming a hollow housing, said electrical conduit means being disposed within one of said housings;

a top disposed between said arms, a member comprising a back surface and a bed surface, said member being disposed between said arms, and further comprising pivot means operatively connected to said member for moving said member, said pivot means being disposed within the plane of said member, with its pivot axis being midway between the sides of said member so that said member is balanced with respect to said pivot means and said member is upright in the seating mode, whereby said member is pivotally movable from a seating mode to a bed mode, and said lamp is moved to said first position for reading while in the seating mode and to said second position for reading while in the bed mode.

* * * * *